United States Patent [19]

Coccagna

[11] Patent Number: 4,866,971

[45] Date of Patent: Sep. 19, 1989

[54] METHOD OF MANUFACTURING PRONGED SKIRT CLIP

[75] Inventor: Abramo B. Coccagna, Shelton, Conn.

[73] Assignee: Cooper Industries, Inc., Houston, Tex.

[21] Appl. No.: 185,251

[22] Filed: Apr. 20, 1988

Related U.S. Application Data

[63] Continuation of Ser. No. 924,094, Oct. 28, 1986, abandoned.

[51] Int. Cl.[4] ..... B21D 28/06

[52] U.S. Cl. ..... 72/338; 72/398; 72/403; 402/14; 24/703.1; 24/265 A

[58] Field of Search ..... 72/338, 339, 330, 337, 72/331, 403, 398; 402/6–8, 1, 25, 18, 15, 14; 412/33, 6; 24/153 R, 703.1, 265 A, 350

[56] References Cited

U.S. PATENT DOCUMENTS

| | | | |
|---|---|---|---|
| 58,667 | 10/1866 | Morgan | 402/14 |
| 66,968 | 7/1867 | Kendig | 402/14 |
| 158,337 | 12/1874 | Tucker | 72/338 |
| 289,245 | 11/1883 | Frank | 24/153 R |
| 1,884,937 | 10/1932 | Waterman | 72/403 |
| 2,035,436 | 3/1936 | Schafer . | |
| 2,546,303 | 3/1951 | Holle | 24/153 R |
| 3,042,984 | 7/1962 | Merfield . | |
| 3,418,706 | 12/1968 | White | 72/330 |

FOREIGN PATENT DOCUMENTS

| | | | |
|---|---|---|---|
| 86905 | 5/1895 | Fed. Rep. of Germany | 24/153 R |
| 1959881 | 6/1970 | Fed. Rep. of Germany | 72/339 |
| 917660 | 1/1947 | France | 72/398 |
| 7531 | of 1896 | United Kingdom | 24/153 R |
| 24908 | of 1896 | United Kingdom | 24/153 R |
| 15265 | of 1901 | United Kingdom | 72/330 |
| 23486 | of 1909 | United Kingdom | 24/153 R |

*Primary Examiner*—Daniel C. Crane
*Attorney, Agent, or Firm*—Alan R. Thiele; Eddie E. Scott

[57] ABSTRACT

A clip and process for its manufacture includes feeding a strip into a cutting and bending machine. The strip is formed into blanks such that one end of the blank has two prongs. The border of the area between the prongs on the first end matches the outline of the prong on the second end. The clip is then bent into a C-shape and the prongs are bent inwardly.

1 Claim, 2 Drawing Sheets

Fig. 1
(PRIOR ART)
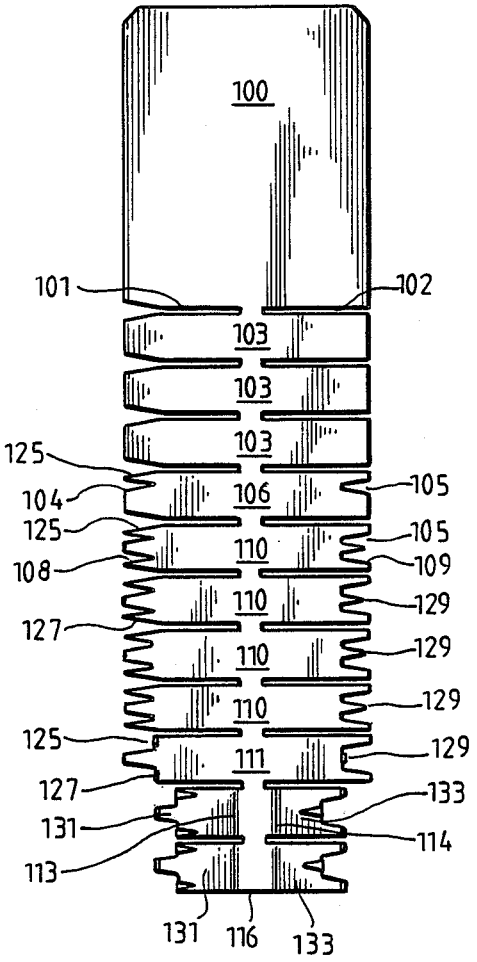
Fig. 2
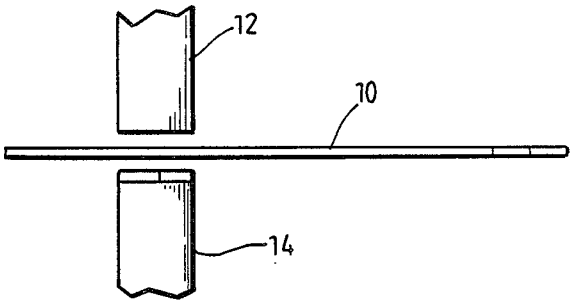
Fig. 2A
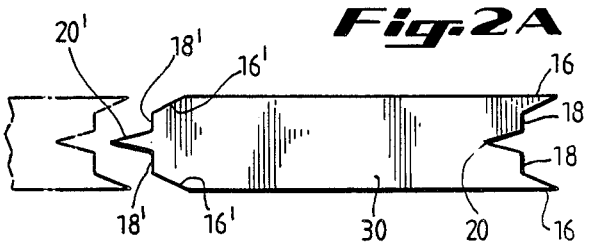
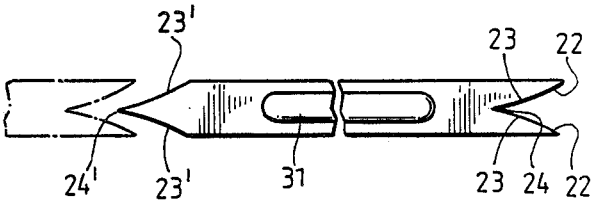
Fig. 2B
Fig. 3
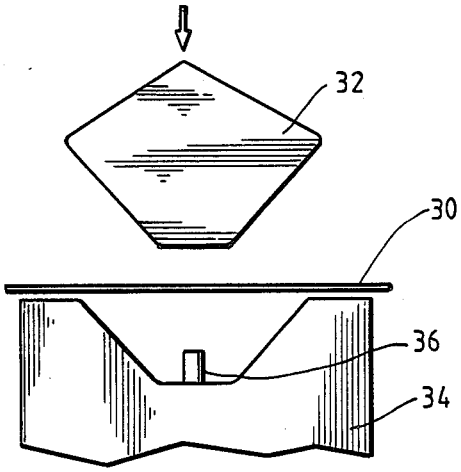

Fig. 3A
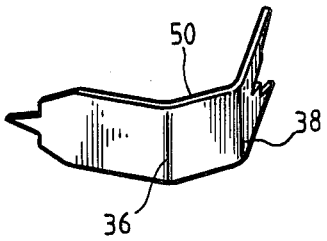
Fig. 4
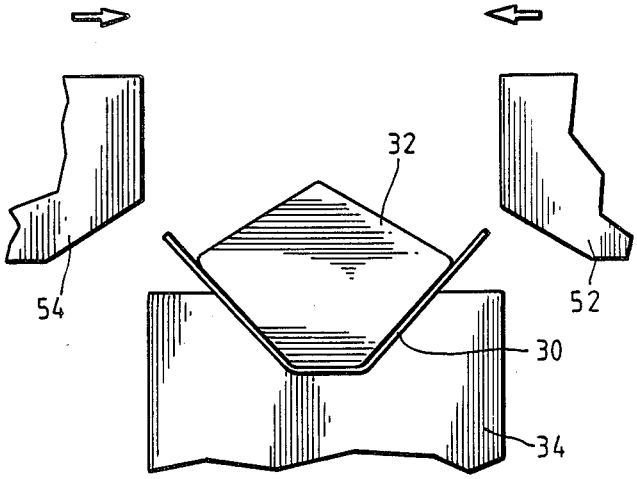
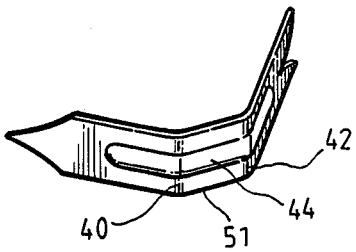
Fig. 3B
Fig. 4A
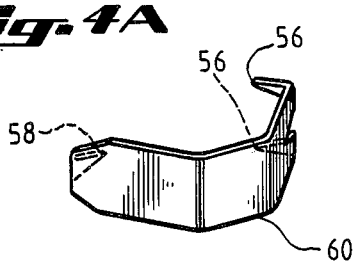
Fig. 5
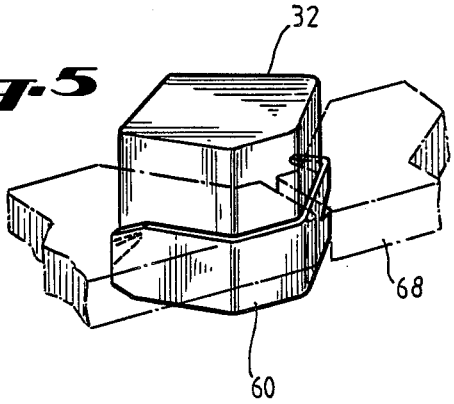
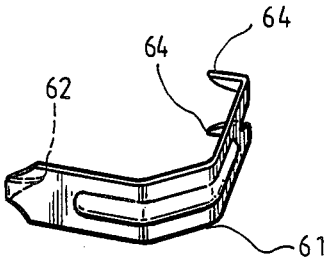
Fig. 4B

METHOD OF MANUFACTURING PRONGED SKIRT CLIP

This application is a continuation, of application Ser. No. 924,094, filed Oct. 28, 1986, now abandoned.

BACKGROUND OF THE INVENTION

The present invention relates to small clips and more particularly to small attachment clips having gripping prongs on their ends.

Pronged clips such as those described herein are typically used by dry cleaners and laundries for fastening skirts, dresses, ties and other articles to wire clothes hangers. Additionally, such pronged clips have been used for attachment of cards or tags to various articles for the purposes of identification.

Prior art clips and their methods of manufacture produce a relatively large amount of scrap. Scrap is costly to manufacturers as it represents wasted material. Additionally, the prior art processes of forming pronged clips have required complex tooling and numerous forming and stamping operations. This has dramatically reduced the production rate of pronged clips and increased the cost of their manufacture. Highest among these costs are the down time and labor associated with sharpening the required tooling.

There is therefore a need in the art to provide a pronged clip and method for its manufacture which can produce pronged clips at manufacturing rates much higher than those taught by the prior art. Such pronged clip design and method of manufacture should eliminate scrap, and should not require the use of complex tooling or excessive tool maintenance.

SUMMARY OF THE INVENTION

A simple, scrap free, rapid process for making a pronged clip is taught by the method of manufacture and pronged clip design of the present invention. A band of material is cut off in a unique configuration such that two straight prongs are formed on the first end of a clip blank. The unique cut configuration causes a single prong to be formed on the second end of the clip blank. Specifically, the cutoff configuration forms an area between the two prongs on the first end whose outline is exactly the shape of the single prong formed on the second end of the clip blank. These matching outlines eliminate scrap. Once the clip blank has been cut from the band of material, it is bent into a C-shape. In order for the clip to be used for its desired function, the prongs are bent inwardly into the central portion of the C-shape. Finally, the completed pronged clip is removed from the forming machine by stripping it from the forming dies.

The pronged clip may also be formed to include a boss in its central portion. Such bosses are included for added strength.

It has been found that a variety of cutoff configurations may be used. Such cut off configurations include both straight sided and curved sided prongs. The key to these cutoff configurations is that the outline of the area between the two prongs formed on the first end is exactly the same as the outline of the single prong formed on the second end.

BRIEF DESCRIPTION OF THE DRAWINGS

A better understanding of the process of manufacture and pronged clip device of the present invention may be had by reference to the drawings wherein:

FIG. 1 is a description of the prior art;

FIG. 2 is a schematic of the cutoff operation;

FIG. 2A is a front elevational view of a clip having straight sided prongs;

FIG. 2B is a front elevational view of a clip having curved sided prongs;

FIG. 3 is a schematic of the bending operation;

FIG. 3A is a perspective view of a bent clip;

FIG. 3B is a perspective view of a bent clip with a boss formed therein;

FIG. 4 is a schematic of the prong bending process;

FIG. 4A is a perspective view of a clip having the prongs bent inward;

FIG. 4B is a perspective view of a clip having a boss with the prongs bent inward; and FIG. 5 is a schematic of the die stripping operation.

DESCRIPTION OF THE EMBODIMENTS

A complete understanding of the manufacturing process and pronged clip device of the present invention can better be obtained by an understanding of prior art method of manufacturing pronged clips. As shown in FIG. 1 a wide band of metal 100 is fed into a punch press machine (not shown). The operations on the wide band of metal 100 include forming cuts 101 and 102 in blank 100 which results in first shape 103 being formed. The next operation is the making of second cuts 104 and 105 which results in prong 125 being formed at the left end of second shape 106. This step is followed by third cuts 108 and 109 which results in the creation of second prong 127 on the left end of third shape 108 and a single prong 129 on the right end.

Because of the complexity of the dies used in such forming operations it is sometimes necessary to place the dies far away from each other in order to accomplish the cutting operations. Accordingly, the series of three first shapes 103 and four third shapes 110 is a result of die spacing.

Once third shape 110 has been formed, prongs 125, 127 and 129 must be bent inward thus causing the formation of fourth shape 111. The next operation is to form bends 113 and 114 in the blank die forms which result in legs 131 and 133. Once the downardly bent legs 131 and 133 have been formed the clips are cut off at edge 116. This prior art method of forming pronged clips results in approximately 30% scrap and frequent sharpening of the complex tooling involved.

The manufacturing process and the unique clip design of the present invention takes an entirely different approach. Rather than feeding the blank of material into a press sideways, a band or ribbon of metal 10 is fed into the press along its long axis. Accordingly, pronged clips can be formed continuously and at a much higher rate. If desired, multiple ribbons may be used; however, for ease of understanding the following description will be based on a forming operation using a single band or ribbon of material 10.

The initiation of the manufacturing process is shown in FIG. 2. Metal ribbon 10 is fed between die 12 and punch 14 at a predetermined rate sufficient to make pronged clips of a desired length. As die 12 and punch 14 come together ribbon 10 is formed into blanks 30. As may be seen in FIGS. 2A and 2B the configuration of the cutoff profile on the first end shown at the right side of blank 30 forms two prongs 16. On the left or second end of blank 30 the single prong has the same perimeter as the area between the two prongs 16 on the first end of blank 30. Specifically, the two prongs 16 lead into a transverse straight portion 18 which leads into central notch 20. On the second end of blank 30 it may be seen that notch 20 corresponds to prong 20' and straight portions 18 correspond to straight portions 18' and prongs 16 correspond to tapered sides or edges 16'.

While straight sided prongs 16 are shown in the preferred embodiment it will also be understood that it may be possible to have prongs 22 formed with curved edges 23 leading into central notch 24 as shown in FIG. 2B. Such a configuration will result in a single prong 24' having curved sides or edges 23' at the second end of blank 31. Once blank 30 or 31 has been formed to the bending operation shown in FIG. 3 is initiated. For purposes of simplification, the remainder of the operations will be described primarily in terms of blank 30, however it will be understood that the following is also applicable to blank 31.

The bending operation shown in FIG. 3 is accomplished by moving blank 30 between die 34 and trapezoidal shaping tool 32. As die 34 and trapezoidal shaping tool 32 come together retractable pin 36 contacts the central portion of blank 30 and holds blank 30 in position. Once this bending operation is complete blank 30 is transformed into what is shown in FIGS. 3A and 3B as blanks 50 and 51, respectively. In FIG. 3A it may be seen that blank 50 has bends 36 and 38 which transform blank 30 into a C-shape. As shown in FIG. 3B blank 31 has been transformed into blank 51. Blank 51 includes bends 40 and 42 which give blank 31 its C-shape. It is to be particularly noted that blank 51 also includes a raised boss 44 which is frequently added to narrow clips for enhanced strength. It has been found that it is preferable to form boss 44 in clip 31 before forming bends 40 and 42. Bosses 44 may be formed in clips having straight-sided or curved-sided prongs.

The forming operation is completed by the operation shown in FIG. 4. While blank 50 or 51 is still in contact with trapezoidal shaped forming tool 32 bending tools 52 and 54 move inwardly and cause the prongs formed on the first end and second end of blanks 50 and 51 to be bent inwardly. This results in clips 60 and 61 depicted in FIGS. 4A and 4B respectively. It will be noted that in FIG. 4A finished pronged clip 60 has two prongs 56 on a first end and a single prong 58 on its second end. In FIG. 4B may be seen that completed pronged clip 61 has two prongs 64 on its first end and a single prong 62 on its second end.

If desired it may be necessary to remove the formed clips from trapezoidal tool 32. This is accomplished by the use of a tool stripper 68 shown schematically in FIG. 5. Stripper 68 moves down over trapezoidal shaped tool 32 and contacts completed clips 60 or 61 and causes completed clips 60 or 61 to be stripped from trapezoidal shaped tool 32.

It should be noted that a key feature of this invention which allows the clips to be formed with no scrap is the particular configuration of the first end and the second end of the pronged clip. By forming the area described by the first end in a configuration which is the same as the configuration of the second end and feeding the strip of metal lengthwise into the forming machine, all scrap is eliminated. In addition, the required tooling is greatly simplified.

Pronged clips are typically formed of aluminum. As aluminum is a relatively expensive metal the elimination of scrap in this operation can result in great savings to manufacturers.

It has been found that in the prior art process shown in FIG. 1 the scrap amounted to 30%. This 30% scrap loss has been eliminated by the present invention.

It has also been found that the infrequent necessity for sharpening dies in this new process as compared to the prior art process in FIG. 1 has resulted in substantial savings. In the process of the present invention it is necessary to sharpen the tooling after the forming of approximately 6 million pronged clips. In the old or prior art process of FIG. 1 it was necessary to sharpen the tooling after every 2 million clips. Additionally, the tooling used in the old process required at least one and one-half days to sharpen. Using the new process, it takes approximately one hour to sharpen the tooling.

Manufacturing rates have also been increased by the new invention. Using the new process and clip design, pronged clips may be formed at the rate of approximately 350 per minute whereas utilizing the old process and clip design the highest rates achieved were approximately 200 pieces per minute.

It will be understood by those of ordinary skill in the art that the process described in the present invention is conveniently adaptable to a standard four-slide machine.

There is now provided by this invention a pronged clip and process for its manufacture which provides manufacturers with the opportunity for reducing scrap, increasing production rates and reducing the cost of tool maintenance.

While the foregoing invention has been described in accordance with the preferred embodiment it will be understood that the scope of the invention is to be defined only by the appended claims as given meaning by the foregoing specification.

What is claimed is:

1. A scrapless process for making a pronged clip comprising the steps of:

feeding a band of metal at a pre-determined rate;

cutting said band of metal into a series of blanks so that a first end of one said blanks has two prongs and notch therebetween and a second end of said blank has a single prong whose perimeter is described by the perimeter of the area between said two prongs and notch on said first end of said blank, said blanks being cut from said band so that each cut forms a trailing and leading end on successive blanks with the leading and trailing ends being complementary to one another;

forming a boss in the central portion of said blank;

bending said blank into a C-shape around a forming die by forming each end with an angled bend;

bending said prongs on said first and said second end of said blank inward while said blank is wrapped around said forming die; and stripping said bent blank from around said forming die.

* * * * *